US005143246A

United States Patent [19]

Johnson et al.

[11] Patent Number: 5,143,246

[45] Date of Patent: Sep. 1, 1992

[54] RECYCLING GARBAGE SEPARATOR

[76] Inventors: Rose A. Johnson, 210 Belle Lake Dr., Nashville, Tenn. 37221; Deborah L. Johnson, 3199A Post Woods Dr., NW., Atlanta, Ga. 30339; Barbara J. Rogers, 7124 Old Harding Pike, Nashville, Tenn. 37221; Kenneth C. Spain, Jr., 1004 Fairwin Ave., Nashville, Tenn. 37216

[21] Appl. No.: 745,765

[22] Filed: Aug. 16, 1991

[51] Int. Cl.[5] ..... B65F 1/08

[52] U.S. Cl. ..... 220/524; 220/909; 220/23.83; 220/676; 220/761

[58] Field of Search ..... 220/94 R, 676, 909, 220/908, 23.4, 524, 23.83

[56] References Cited

U.S. PATENT DOCUMENTS

| | | | |
|---|---|---|---|
| 1,766,258 | 6/1930 | Parkerson | 220/501 |
| 3,032,230 | 5/1962 | Gerber | 220/94 R |
| 3,321,130 | 5/1967 | Cleghorn | 220/94 R |
| 4,023,702 | 5/1977 | McKnight | 220/94 R |
| 4,478,344 | 10/1984 | Rehrig | 220/676 |
| 4,558,799 | 12/1985 | Hammond | 220/908 |
| 4,720,021 | 1/1988 | Byrns | 220/94 R |
| 4,801,034 | 1/1989 | Sandomeno | 220/909 |
| 4,834,262 | 5/1989 | Reed | 220/909 |
| 4,867,328 | 9/1989 | McCarthy | 220/909 |
| 4,878,592 | 11/1989 | Lee | 220/909 |

FOREIGN PATENT DOCUMENTS

| | | | |
|---|---|---|---|
| 3236786 | 4/1984 | Fed. Rep. of Germany | 220/23.4 |
| 1533841 | 11/1978 | United Kingdom | 220/909 |

*Primary Examiner*—Stephen Marcus
*Assistant Examiner*—S. Castellano
*Attorney, Agent, or Firm*—James G. Gatto

[57] ABSTRACT

The invention is directed to a recyclable garbage separator having an outer container and a plurality of modular inner containers adapted to be locatable within the outside container. The outside container may have pivotable cover portions having openings therein substantially corresponding to the size of the openings in the upper surface of the inner containers. The structure may be formed of recycled material and the outer container may have large openings formed in the walls thereof to reduce the weight of the container and the amount of material necessary to make the container.

7 Claims, 3 Drawing Sheets

RECYCLING GARBAGE SEPARATOR

FIELD OF THE INVENTION

The present invention relates generally to waste receptacles and more specifically to a waste receptacle for separating recyclable trash.

BACKGROUND OF THE INVENTION

Separating different types of recyclable components of trash or refuse from each other or from non-recyclable trash is common in many households and is becoming mandatory in many communities. The standard household garbage can is not practical for separating, e.g., glass, aluminum and/or plastic materials, because it has only a single receptacle into which waste may be received. Of course, a plurality of such receptacles may be used. However, this can be a problem if space is limited. Moreover, it is aesthetically undesirable to have a number of waste receptacles.

Various solutions to this problem have been proposed, but all of these solutions have certain drawbacks or limitations.

For example, U.S. Pat. No. 4,801,034 discloses a structure for recycling materials having a base and integral dividers for receiving a series of identically sized and shaped receptacles. This structure fails to realize that different types of trash (e.g., glass, aluminum cans, paper, etc.) do not accumulate at the same rate. The structure disclosed in this patent lacks flexibility in enabling different size compartments. Moreover, while the compartments receive a receptacle having a handle, the upper edge of the receptacle has a step formed therein to receive the handle. Moreover, the handle appears to be substantially centrally located with respect to the opening.

U.S. Pat. No. 4,893,719 discloses three separate receptacles for storing recyclable materials. The receptacles are merely held together by a cover which fits over the top of the receptacles. Moreover, these receptacles are all the same size and do not have handles.

U.S. Pat. No. 4,834,262 discloses a structure for retaining several garbage bags for purposes of recycling. The use of trash bags is undesirable. Moreover, the containers are all of equal size, and the size is substantially fixed by the configuration of edge 32 which is arranged to fit into slot 22 between the compartments.

U.S. Pat. No. 4,874,111 discloses a structure with fixed receptacles for retaining several garbage bags for purposes of recycling. This structure is also undesirable due to the use of trash bags and the fixed size of the compartments.

U.S. Pat. No. 4,878,592 discloses a garbage can, apparently intended for outdoor use, having an opening to receive a plurality of receptacle units of different sizes. However, the receptacles lack pivotable handles, and, as suggested by FIG. 2, are of a fixed size.

U.S. Pat. Nos. 4,867,328; 4,905,853; 4,893,722 and 4,834,253 all disclose receptacle structures having features generally similar to those described above and therefore generally similar drawbacks.

In spite of these various known structures for recycling, the need remains for a compact, convenient structure for holding a variety of different sized rigid inner containers, without the need to use plastic bags to line the containers. The use of such bags is awkward, time consuming, and environmentally undesirable. Moreover, the various handle structures for the modular containers are also awkward and inefficient. The failure to provide flexibility in the use of various reconfigurations of inner containers based on the different accumulation rates of different types of trash is also a drawback. Moreover, the desirability of minimizing the weight of the structures and the possibility of using substantially recyclable material to make the structures are also not recognized in various prior art references.

SUMMARY OF THE INVENTION

It is an object of the present invention to overcome these and other drawbacks of the prior art.

It is a further object of the present invention to provide a structure for receiving and separating different types of recyclable wastes, featuring a rigid, lightweight outer container designed to hold several inner containers, each of which may hold different types of waste.

It is a further object of the present invention to provide several different sized and shaped inner containers to receive different types of waste, wherein one of the inner containers may be emptied without necessarily emptying the other inner containers.

It is an object of the present invention to provide lightweight, yet sturdy, inner containers made of molded plastic, wherein the containers are watertight and easily cleanable, thus obviating the need for plastic liners.

It is still a further object of the present invention to provide a lightweight outer container made of molded plastic, wherein the side walls of the outer container have relatively large openings formed therein to reduce the weight and the amount of material necessary to form the structure, while retaining sufficient strength to hold the inner containers upright.

It is an object of one embodiment of the present invention to provide a pair of hinged covers on the outer container, the hinged covers having apertures therein to provide access to the inner containers.

It is a further object of the present invention to provide each of the inner containers with a U-shaped handle pivotable about the inner container opening, between a stored position, where the handle rests inside the perimeter of the inner container and is supported by a protrusion formed in a side wall of the inner container, and a carrying position, wherein a user may lift an inner container using only one hand.

It is still a further object of the present invention to provide a handle on the inner container that allows easy emptying of the inner container by keeping the user's hand free from the flow of waste.

DETAILED DESCRIPTION OF THE DRAWINGS

Figure 1:
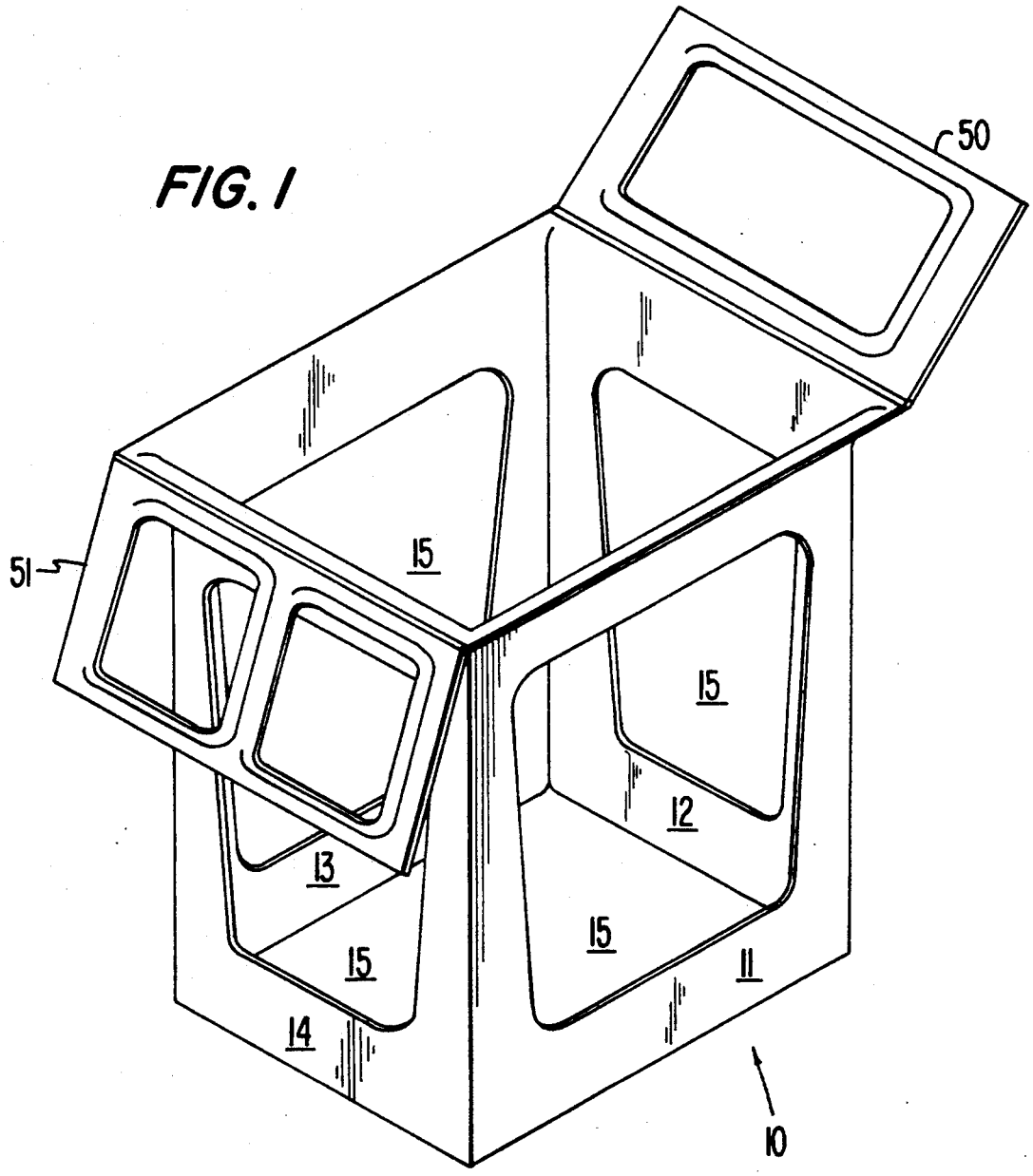
FIG. 1 is a diagrammatic representation of an outer container which may be used according to the present invention.
Figure 4:
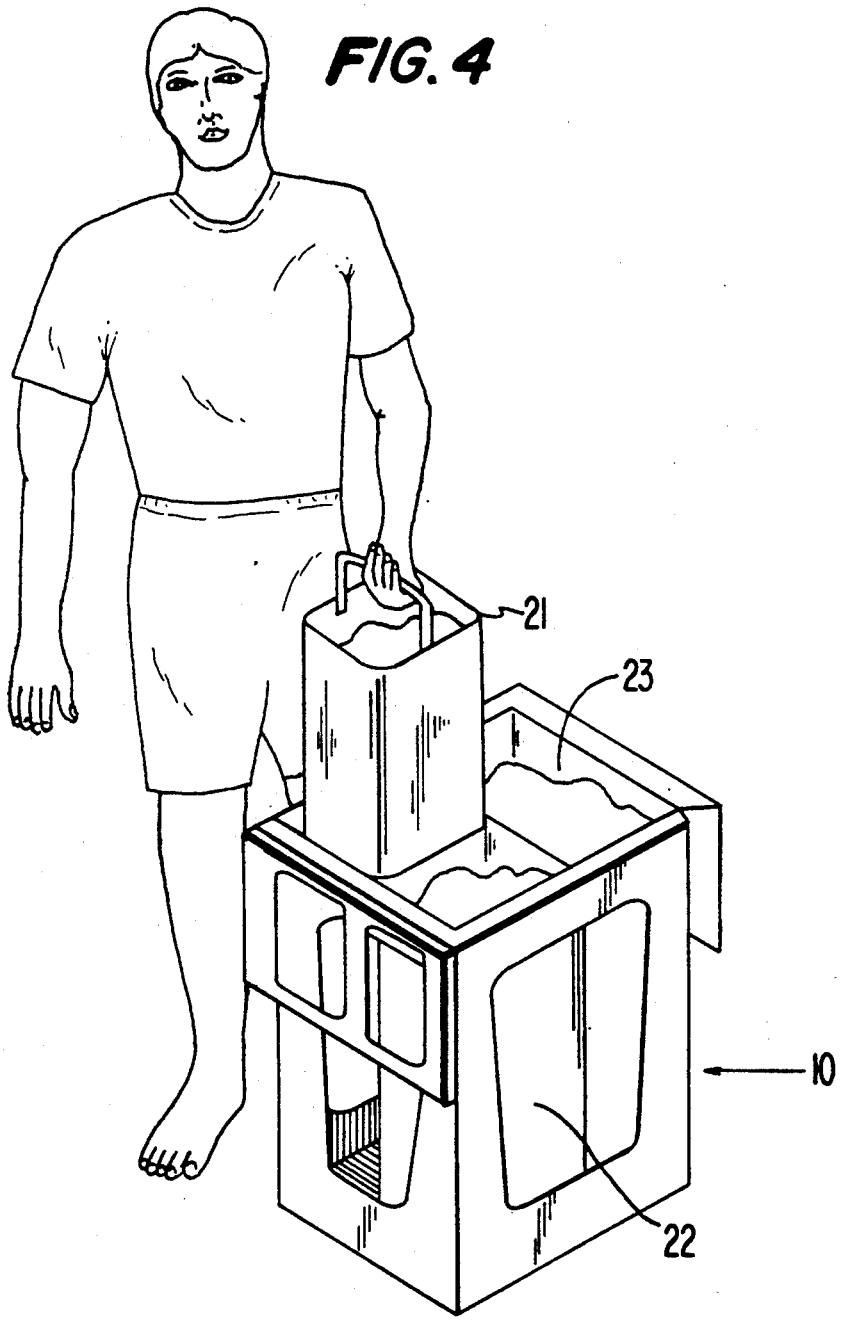
FIG. 4 is a diagrammatic illustration of a user lifting an inner container from the outer container according to one embodiment of the present invention.

Referring to the drawings, FIG. 1 shows an outside container according to one embodiment of the present invention. The outside container, indicated as 10, is generally rectangular in shape as defined by four side walls 11–14. According to one embodiment, there is no bottom wall to the outside container since a bottom is not necessary to hold the inside containers upright. The outside container can be made in any convenient size, but in the preferred embodiment, it fits conveniently within a kitchen or garage area to receive therein a plurality of inside containers, e.g., containers 21, 22 and 23 (FIG. 4). Of course, a bottom wall may be used if desired, but by not providing a bottom wall, material is saved and the weight of the structure is reduced.

The four side walls 11–14 are preferably formed of lightweight, but sturdy, molded plastic. Preferably, each side wall has a relatively large opening 15 formed therein to reduce the amount of material needed to form the structure and further to reduce the weight of the structure without compromising the structural integrity thereof.

Since there are no dividers within the outside containers, the outside container can hold a variety of different sized inside containers. Moreover, the inside container configurations can be varied (i.e., reconfigured) as desired to optimize storage space based on the accumulation rate of the type of trash being stored therein.

Figure 2:
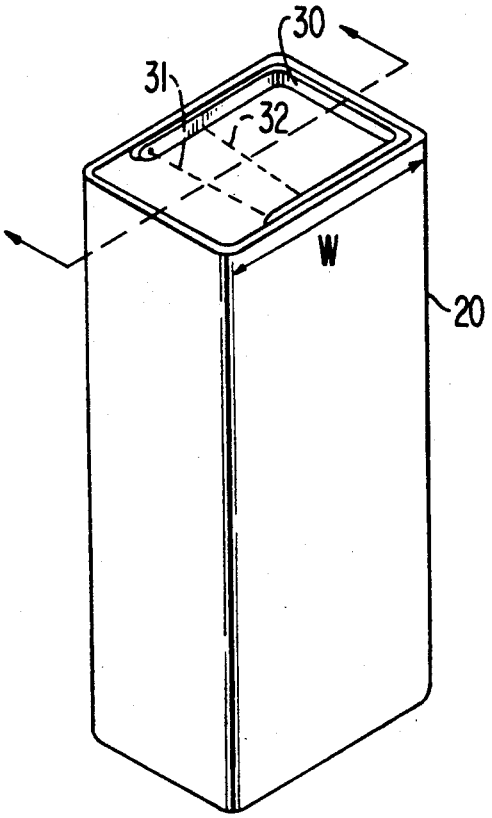
FIG. 2 is a diagrammatic representation of an inner container which may be used according to the present invention.

The inside containers, indicated generally as 20, are also preferably generally rectangular in shape (FIG. 2). Each inside container has four side walls, an integral bottom, and an opening at an upper area thereof. The inside containers are preferably formed of lightweight, but sturdy, molded plastic to provide a watertight, rigid receptacle strong enough to contain waste, including for example, aluminum cans.

According to one embodiment (FIGS. 2 and 3), each inside container has a generally U-shaped handle 30 which may also be formed of lightweight molded plastic Handle 30 has a thickness T. The handle 30 enables a user to lift a filled inside container out of the outside container and carry it to a larger receptacle or new recycling facility.

The handle 30 is preferably pivotally attached to two opposing side walls of the inside container 20. The axis 31, about which the handle pivots, is spaced from an axis 32 corresponding to an axis substantially perpendicular to the side walls to which the handle is attached and located at a distance W/2 from either edge of such side wall of the inner container 20. This allows handle 30 to be longer in length L than half the width W of the side wall of the inside container. Preferably, the handle 30 rests within the perimeter of the container as shown in FIG. 2, to allow greater clearance between a user's hand and the material to be emptied from a filled container.

Figure 3:
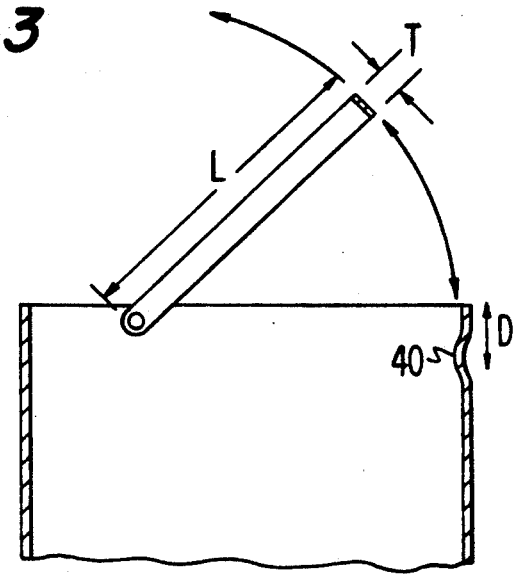
FIG. 3 is a partial sectional view of the upper portion of the inner container of FIG. 2.

In order to enable the handle to be nested within the inner container 20, an indentation 40 or other support surface is formed in one of the side walls of inner container 20, preferably, the side wall farthest from the points where the handle is pivotally attached to the inner container 20, as best seen in FIG. 3. The indentation 40 serves to provide a rest stop for the handle 30 within the perimeter of the inside container 20. The indentation 40 is provided at a distance D below the upper (open) edge of the inner container 20. Preferably, the distance D substantially corresponds to the thickness (T) of handle 30.

In use, a plurality of inside containers 20 will be used with the outside container. According to a preferred embodiment, three inside containers (e.g., 21, 22, 23, of FIG. 4) are used where one inside container comprises approximately one-half the volume of the space defined by the outside container 10 and two inside containers each comprise one quarter of the volume of the space defined by the outside container 10. This arrangement allows, for instance, the larger inside container to store trash that accumulates at a relatively faster rate, while the smaller inside containers can be used to store trash that accumulates at a relatively slower rate. However, the inside containers may comprise three containers taking up one-half, one-third and one-sixth of the space within the outside container. Numerous other configurations are also envisioned. Thus, each inside container has a size optimally corresponding to the rate of accumulation of the type of trash it is designed to store. Moreover, each inside container can be emptied at a recycling center or outside garbage can without transporting the other two inside containers which may not be filled at the time. Due to the flexibility resulting from not having dividers within the outside container 10, more or fewer inner containers may be used. Additionally, different configurations of inner containers can also be used.

Because the inside containers are both rigid and waterproof, no trash bags are needed. The molded plastic makes the containers both lightweight and easily cleanable.

According to an embodiment of the invention, the outside container comprises a pair of hinged covers 50, 51 (FIG. 1). The hinged covers 50, 51 have openings 51 to allow access to the inner containers 20 when the covers are in a closed position. Preferably, the openings formed therein are of substantially the same size as or slightly smaller than the sizes of the openings in the inside containers 20. When used, covers 50, 51 can further support the inside containers 20 at the upper perimeter thereof, but the covers 50, 51 are not necessary for support. The covers may also be reconfigurable to correspond to the configuration of inner containers. For this purpose, if desired, the covers may be pivotably attachable to the outer container.

The foregoing is a description of the preferred embodiments of the present invention. However, the invention is not so limited. Various modifications and alternatives will be readily apparent to one of ordinary skill in the art. The present invention is only limited by the claims appended hereto.

We claim:

1. A structure for separately storing various types of refuse, comprising:

an outer container comprising an outer frame for receiving a plurality of rigid inner containers, said outer frame comprising four side walls generally configured to define a single rectangular opening said side walls of said outer container each having a relatively large opening formed therein to minimize thereby the weight of the outer container and the amount of material necessary to make the structure;

a first cover portion pivotally attached to a first side wall of said outer container and a second cover portion pivotally attached to a second side wall of said outer container, said first and second cover portions each having one or more openings formed therein;

wherein said plurality of inner containers have a generally rectangular shape defined by four connected side walls and a connecting bottom wall for sealing the bottom portion of each inner container, said inner containers further comprising an open end opposite to said bottom wall through which said refuse may be inserted into said inner containers;

and wherein said inner containers each comprise a handle pivotally attached to an opposing pair of said four side walls of said inner container at points spaced from the midpoint of said opposing pair of side walls.

2. The structure of claim 1 wherein said handle is adapted to be pivotable to enable it to be nested within said inner container, wherein said inner container has an indentation formed in one of said side walls to serve as a rest stop for said handle.

3. The structure of claim 2 wherein said indentation is formed in said side wall at a position below the upper edge of said side wall substantially corresponding to the thickness of said handle.

4. The structure of claim 1 wherein said inner containers comprise a first inner container having a size approximately equal to one half the volume of the outer container and two additional inner containers each having a size corresponding to approximately one fourth of the volume of the outer container.

5. The structure of claim 1 wherein the side walls of said outer container are formed substantially of recycled material.

6. The structure of claim 1 wherein the cover portions of said structure are formed substantially of recycled material.

7. The structure of claim 1 wherein said inner containers are formed substantially of recycled material.

* * * * *